United States Patent [19]

Whitaker et al.

[11] Patent Number: 4,824,042

[45] Date of Patent: Apr. 25, 1989

[54] UNIVERSAL PACKAGE HOLDER

[76] Inventors: Ross C. Whitaker, 2768 Tanglewood Dr.; Richard E. Edwards, 3729 Thrushwood Dr., both of Chattanooga, Tenn. 37415

[21] Appl. No.: 186,354

[22] Filed: Apr. 26, 1988

[51] Int. Cl.[4] ..... B65H 49/06

[52] U.S. Cl. ..... 242/130; 242/131; 242/141

[58] Field of Search ..... 242/130, 130.1, 130.2, 242/130.3, 130.4, 131, 131.1, 129.5, 129.7, 129.71, 134, 141

[56] References Cited

U.S. PATENT DOCUMENTS

| | | | |
|---|---|---|---|
| 412,853 | 10/1889 | Keene | 242/131 X |
| 666,943 | 1/1901 | Thompson | 242/130 X |
| 1,508,105 | 9/1924 | Kamla | 242/130.1 X |
| 1,904,737 | 4/1933 | Javery | 242/130.1 |
| 2,027,325 | 1/1936 | Skelton | 242/141 X |
| 2,244,662 | 6/1941 | Cushman | 242/129.7 |
| 2,283,373 | 5/1942 | Krafft | 242/130.1 X |
| 2,437,100 | 3/1948 | Lambach | 242/130.1 |
| 2,574,285 | 11/1951 | Rea | 242/130.1 X |
| 2,738,139 | 3/1956 | Williams | 242/130 |
| 3,580,524 | 5/1971 | Weaver | 242/130 X |
| 3,633,844 | 1/1972 | Sordoni | 242/130 |
| 3,744,735 | 7/1973 | Koenig | 242/130 |
| 3,977,687 | 8/1976 | Manganelli | 242/130.1 X |
| 3,987,979 | 10/1976 | Knispel | 242/141 X |

*Primary Examiner*—Stanley N. Gilreath

*Attorney, Agent, or Firm*—Cushman, Darby & Cushman

[57] ABSTRACT

An apparatus for securely holding tubes or cones for use in the tufting industry includes first and second support sections which are formed at an acute angle with respect to each other for engaging the inside of a tube or cone. The support sections are in the preferred embodiment formed from resilient wire elements which deflect under pressure that is applied from the inside of the tube or cone, thereby assuring a secure fit. The wire elements forming the second support element further flare outwardly to conform to the shape of a cone. An additional advantageous feature is the provision of a pair of wire loops at a distal end of the second support element to prevent a tube or cone from sliding thereover. The main feature which provides support for the package is the wire portion which connects the loops. This wire portion gives the holder its rigidity when it contacts the creel rod by restraining vertical and horizontal movement of the package.

13 Claims, 1 Drawing Sheet

14
36
12
34

24
22
32
16
20
26
30
18
28
30
26
3
14
12
3
12
14
20
10
18

38

UNIVERSAL PACKAGE HOLDER

BACKGROUND OF THE INVENTION

1. Field of the Invention

The present invention relates to package holders which are used in the tufting industry for holding conical or cylindrical spools of yarn to be dispensed. More particularly, the present invention relates to an improved universal package holder which is capable of securing many of the different types and shapes of spools which are used in the industry today to a creel rod or other support.

2. Description of the Prior Art

In the past, standard spring wire cone holders have been used to secure conical yarn holding spools to a creel rod so that the yarn could be fed out to a knitting machine or the like. An example of such a holder is disclosed in U.S. Pat. No. 2,283,373 to Krafft. This holder included a bobbin engaging member having a rectangular cross section which was bent back upon itself so as to engage a conical spool placed thereover at three different points. However, a disadvantage of this type of spool holder was its ineffectiveness in securing conical spools which were larger or smaller than those for which the holder was designed. In addition, such holders were ineffective in securing spools having a cylindrical cross section, which have become more popular in recent years.

Another device which was designed to hold exclusively conical spools of twine is disclosed in U.S. Pat. No. 666,943 to Thompson. In this device, a piece of resilient wire bent midway along its length was employed to engage the inner portions of a conical spool placed thereon. This holder had utility only for holding conical spools of a certain size, and would appear to be completely ineffective for securing spools having a cylindrical cross section against movement with respect to an external support.

In view of the above, it is clear that there has existed a long and unfilled need in the prior art for a spool holder which can effectively secure conical or cylindrical spools of all different sizes against movement with respect to a creel rod or other external support.

SUMMARY OF THE INVENTION

Accordingly, it is an object of the invention to provide a spool holder which is effective in securing cylindrical or conical spools of different sizes to a creel rod or other external support.

In order to achieve this goal, a universal package holder according to the present invention includes a first support section formed in a first lower plane by first and second elongate wire portions, which are substantially parallel, a second support section formed in a second upper plane by the first and second wire portions, the first and second planes forming an acute angle with respect to each other, a loop formed in each of the first and second wire portions at a distal end of the second support section for preventing packages placed on the holder from sliding thereover and at least one support element for attaching the first support section to an external support such as a creel rod.

According to one facet of the present invention, the first and second wire portions in the second support section may be shaped to diverge in a direction away from the first support section so as to define an acute angle therebetween. In this way, the universal package holder according to the present invention is given a shape which complements the inside of a conical spool. When such a spool is slid over the universal package holder, the holder deflects in two separate directions, which allows spools having a wide range of shapes and sizes to be secured thereon. In addition, the loop portions formed at the distal end of the second support section prevent large spools which may be placed upon the universal package holder from slipping off of the holder during use. This solves a problem which was particularly troublesome in regard to the mounting of cylindrical spools.

Other objects, features, and characteristics of the present invention as well as the methods and operation and functions of the related elements of the structure, and to the combinations of parts and economies of manufacture, will become apparent upon consideration of the following description and the appended claims with reference to the accompanying drawings, all of which form a part of this specification, wherein like reference numerals designate corresponding parts in the various Figures.

DETAILED DESCRIPTION OF THE PREFERRED EMBODIMENT

Figures 1, 2, 3:
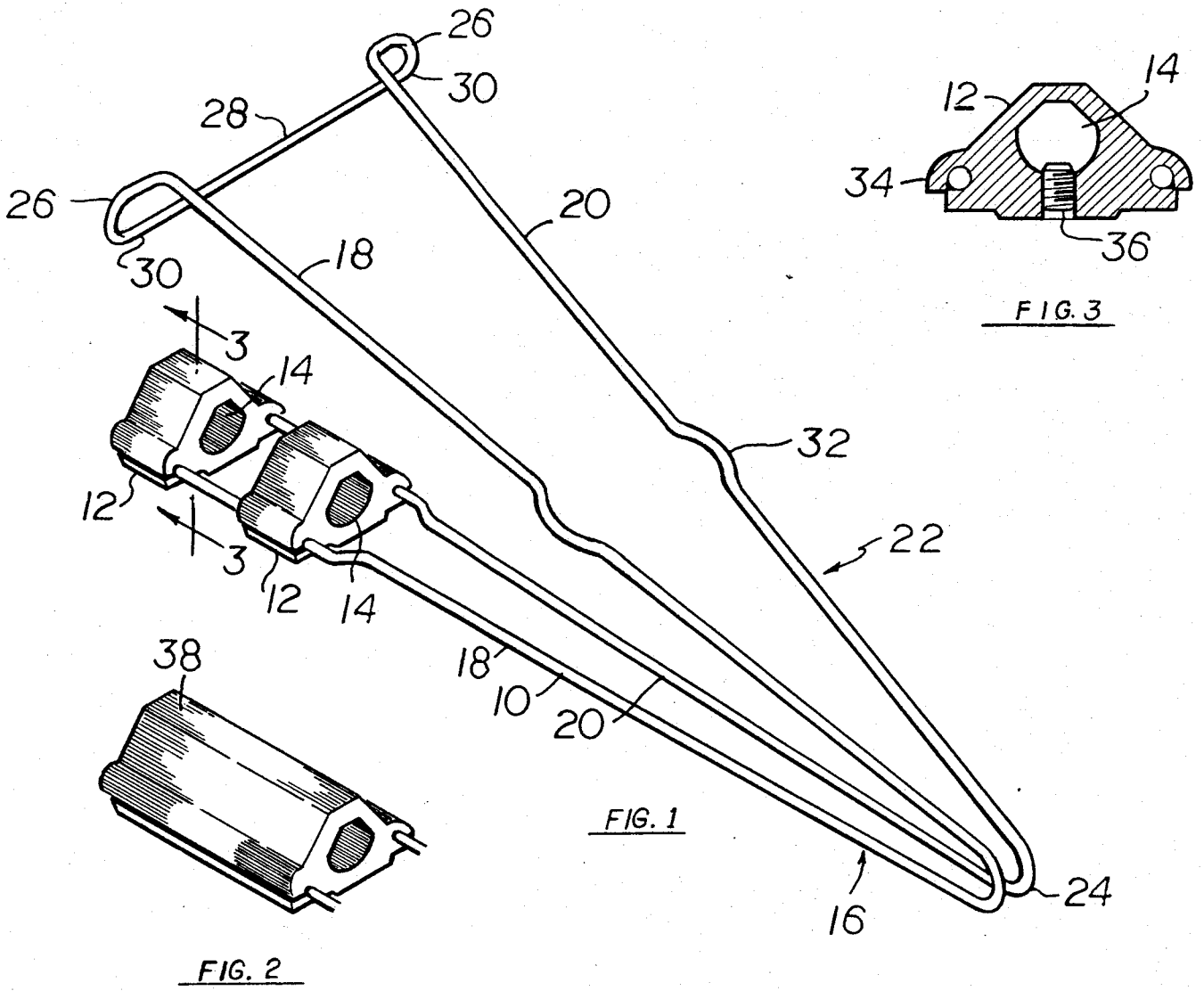
FIG. 1 is perspective view of a universal package holder constructed according to a first embodiment of the present invention.
FIG. 2 is a perspective view of a modified support element which constitutes a second embodiment of the present invention.
FIG. 3 is a cross-sectional view taken along the lines 3—3 in FIG. 1.

Referring to FIG. 1, a first embodiment of the present invention includes a resilient wire 10 which is formed into first and second wire portions 18, 20, respectively. The first and second wire portions 18, 20 together form a first support section 16 in which the first and second wire portions 18, 20 extend substantially parallel to one another.

The first and second wire portions 18, 20 are attached to an external support such as a creel rod by a pair of extruded support elements 12. Support elements 12 each have a borehole 14 defined therein for receiving a creel rod, and a set screw 36 for securing each support element 12 to the creel rod, as is shown in FIG. 3. As is illustrated in FIG. 1, the axis of the boreholes in which a creel rod may be received is substantially parallel to the axis of the first support section 16. As a result, the first support section 16 will be substantially parallel to a creel rod on which the universal package holder of the present invention is placed.

As is illustrated in FIG. 3, each of the extruded support elements 12 are provided with a slot or eyelet 34 on each side thereof for receiving the first and second wire portions 18, 20, respectively, of the first support section 16. Wire portions 18, 20 may be fastened within the slides or eyelets 34 by any one of a number of conventional processes such as, for example, crimping or welding.

At an end of the first support section 16 that is remote from the extruded support elements 12, wire portions 18, 20 are bent back on themselves to form a second support section 22, as illustrated in FIG. 1. Second support section 22 is formed to lie in a plane that is positioned at an acute angle with respect to the plane in which first support section 16 is disposed. When a package such as a spool of yarn is placed over the universal package holder of the present invention, the second support section 22 will be caused to deflect with respect to first support section 16, lessening the angle therebetween, and causing both the first and second support sections 16, 22 to resiliently bear against the inside portion of the package.

As is shown in FIG. 1, the first and second wire portions 18, 20 in the second support section 22 diverge in a direction away from the first support section 16 so as to further define an acute angle between the first and second wire portions. As a result, the package holder of the present invention is given a shape so as to complement the interior of a conical spool. When a conical spool is placed over the package holder of the present invention, the first and second wire portions 18, 20 of the second support section 22 will deflect toward one another, thereby lessening the angle therebetween and causing the first and second wire portions 18, 20 to bear against the inside of the package. In this way, the package holder of the present invention resiliently contacts the inside of a conical spool in two component directions, by the deflection of the first support section 16 with respect to the second support section 22, and by the deflection of first wire portion 18 with respect to the second wire portion 20.

As shown in FIG. 1, first and second wire portions 18, 20 of the second support section 22 are bowed outwardly at a central portion thereof so as to form a pair of outward protrusions 32. Protrusions 32 further dig into the interior of a package that is placed upon the universal package holder, thus ensuring a secure fitting thereon. Although in the preferred embodiment protrusions 32 are shown as having a gentle curvature, it is to be understood that they could be given a sharper curvature or a pointed configuration as well.

One important facet of the present invention is the provision of a pair of loop portions at a second end of the second support section 22 which is distal from the first support section 16. Loop portions 26 are formed so as to present a surface 30 which is substantially perpendicular to the extent of the first and second wire portions 18, 20 in second support section 22. Loop portions 26 are in the preferred embodiment connected to each other by a third wire portion 28, which provides additional structural stability to the device. Third wire portion 28 forms a support surface 30 which provides support for a package placed thereon.

When a package is slipped over the device, loop portions 26 prevent the package from sliding thereover, and engagement of the perpendicular support surface 30 with the creel rod secures the package against movement in both the vertical and horizontal directions. Loop portion 26 is particularly advantageous for use with cylindrical packages, which are inclined to slip downwardly over the creel rod. The restriction of vertical and horizontal movement of the package provided by the engagement of support surface 30 with the creel rod and the support which is given a package by loop portions 26 in conjunction with the double deflection provided by the first and second support sections 16, 22 and the first and second wire portions 18, 20 enables the package holder of the present invention to substantially out-perform those which have previously been used.

FIG. 2 illustrates a second embodiment of the present invention wherein only one extruded support element is provided to secure the first support section 16 to an external support. The extruded support element in the embodiment of FIG. 2 functions in the same manner as the dual support elements described above, and is also provided with a set screw so that it may be secured to a creel rod.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A universal package holder for holding packages having a tubular or conical interior and for securing the same to an external support, comprising:

a first support section formed in a first plane by first and second elongate resilient wire portions, said first and second wire portions being substantially parallel;

a second support section formed in a second plane by said first and second wire portions, said first and second planes forming an acute angle with respect to each other;

means at an end of said second support section which is distal from said first support section for preventing packages placed on the holder from sliding thereover and to provide vertical and horizontal stability for the package;

means at the end of the second support section which is distal from said first support section, to provide vertical and horizontal stability for the package by engaging the external support; and means for attaching said first support section to the external support.

2. Apparatus according to claim 1, wherein said first and second wire portions in said second support section diverge in a direction away from said first support section so as to define an acute angle between said first and second wire portions.

3. Apparatus according to claim 1, wherein at least one outward protrusion is provided on said second support section for engaging the interior of a package slipped thereover.

4. Apparatus according to claim 2, wherein at least one outward protrusion is provided on said second support section for engaging the interior of a package slipped thereover.

5. Apparatus according to claim 1, wherein said means for preventing comprises a loop formed in at least one of said first or second wire portions at said distal end of said second support section.

6. Apparatus according to claim 1, wherein said means for preventing comprises a loop formed in each of said first and second wire portions at said distal end of said second support section.

7. Apparatus according to claim 6, wherein said loop of said first wire portion is connected to said loop of said second wire portion by a third wire portion, said third wire portion defining said means for providing stability by engaging the external support, thereby imparting structural rigidity to the apparatus.

8. Apparatus according to claim 1, wherein said attaching means has a bore defined therein for receiving the external support, and means for connecting said first and second wire portions of said first support section thereto.

9. Apparatus according to claim 1, wherein said attaching means comprises at least one support element, each of said support elements having a borehole defined therein for receiving the external support, and means for connecting said first and second wire portions of said first support section thereto.

10. Apparatus according to claim 9, wherein said connecting means comprises a pair of slots defined in opposite sides of said support element for receiving said first and second wire portions.

11. Apparatus according to claim 9, wherein a set screw is provided in at least one of said support elements for securing said support elements to their external support.

12. Apparatus according to claim 9, wherein there are two support elements.

13. Apparatus according to claim 9, wherein there is only one support element.

* * * * *